United States Patent [19]

Fu et al.

[11] Patent Number: 4,892,641

[45] Date of Patent: Jan. 9, 1990

[54] PROCESS FOR THE PRODUCTION OF MESOPHASE PITCH

[75] Inventors: Ta-Wei Fu, Ponca City, Okla.; Manfred Katz, Wilmington, Del.

[73] Assignee: Conoco Inc., Ponca City, Okla.

[21] Appl. No.: 308,600

[22] Filed: Feb. 8, 1989

Related U.S. Application Data

[63] Continuation-in-part of Ser. No. 99,033, Sep. 21, 1987, abandoned.

[51] Int. Cl.[4] ..... C10G 27/00; C10C 3/04; C10C 3/02

[52] U.S. Cl. ..... 208/39; 208/4; 208/6; 208/44; 423/447.4; 423/447.6; 423/447.7; 423/447.8

[58] Field of Search ..... 208/4, 6, 39, 44; 423/447.6, 447.7, 447.8

[56] References Cited

U.S. PATENT DOCUMENTS

| | | | |
|---|---|---|---|
| 3,116,229 | 12/1963 | Eisenhunt | 208/39 |
| 3,350,295 | 10/1967 | Hamner | 208/4 |
| 3,595,946 | 7/1971 | Joo | 264/29 |
| 3,856,657 | 12/1974 | Sumfield | 208/6 |
| 3,909,389 | 9/1975 | Ruckel et al. | 208/4 |
| 3,974,264 | 8/1976 | McHenry | 423/447.4 |
| 3,976,729 | 8/1976 | Lewis et al. | 423/447.8 |
| 4,017,327 | 4/1977 | Lewis et al. | 106/273 R |
| 4,026,788 | 5/1977 | McHenry | 208/39 |
| 4,042,486 | 8/1977 | Asano et al. | 208/44 |
| 4,096,056 | 6/1978 | Haywood | 208/39 |
| 4,176,043 | 11/1979 | van Eyk | 208/6 |
| 4,209,500 | 6/1980 | Chwastiak | 423/447.6 |
| 4,474,617 | 10/1984 | Nemura et al. | 208/22 |
| 4,575,412 | 3/1986 | Yudate | 208/44 |
| 4,578,177 | 3/1986 | Yudate et al. | 208/44 |
| 4,671,864 | 6/1987 | Sawrun et al. | 208/39 |

FOREIGN PATENT DOCUMENTS

| | | |
|---|---|---|
| 65090 | 4/1985 | Japan . |

*Primary Examiner*—Helane Myers

*Attorney, Agent, or Firm*—C. R. Schupbach

[57] ABSTRACT

An improved process for producing an anisotropic pitch product suitable for carbon fiber manufacture. A carbonaceous feedstock substantially free of mesophase pitch is heated at elevated temperature while passing an oxidatively reactive sparging gas such as air through the feedstock. The oxidatively treated feedstock, which remains substantially free of mesophase pitch, is then heated at a higher temperature in the presence of a non-oxidative sparging gas to produce an anisotropic pitch having from 50 to 100% by volume mesophase which is suitable for producing good quality carbon fibers.

17 Claims, No Drawings

PROCESS FOR THE PRODUCTION OF MESOPHASE PITCH

RELATED APPLICATIONS

This application is a continuation-in-part of co-pending application Ser. No. 07/099,033, filed Sept. 21, 1987 now abandoned.

BACKGROUND OF THE INVENTION

1. Field of the Invention

The present invention pertains to an improved process for producing a carbonaceous pitch product having a mesophase content ranging from about 50 to 100%, which is suitable for carbon fiber manufacture. More particularly, the invention relates to a process for making mesophase containing pitch capable of producing carbon fibers having enhanced properties, by contacting a feedstock with an oxidative gas at an elevated temperature to prepare a mesophase precursor substantially free from mesophase and thereafter subjecting the mesophase precursor to heat treatment in melt phase at a higher temperature in the presence of a non-reactive sparge gas.

2. The Prior Art

In recent years extensive patent literature has evolved concerning the conversion of carbonaceous pitch feed material into a mesophase-containing pitch which is suitable for the manufacture of carbon fibers having desirable modulus of elasticity, tensile strength, and elongation characteristics.

U.S. Pat. No. 4,209,500 (issued to Chwastiak) is directed to the production of a high mesophase pitch that can be employed in the manufacture of carbon fibers. This patent is one of a series of patents pertaining to a process for producing mesophase pitches suitable for carbon fiber production. Each of these patents broadly involves heat treating or heat soaking the carbonaceous feed while agitating and/or passing an inert gas therethrough so as to produce a more suitable pitch product for the manufacture of carbon fibers.

As set forth in the Chwastiak patent, earlier U.S. Pat. Nos. 3,976,729 and 4,017,327 issued to Lewis et al involve agitating the carbonaceous starting material during the heat treatment. The use of an inert sparge gas during heat treatment is found in U.S. Pat. Nos. 3,974,264 and 4,026,788 issued to McHenry. Stirring or agitating the starting material while sparging with an inert gas is also disclosed in the McHenry patents.

U.S. Pat. No. 3,595,946 (Joo et al) discloses heat treating and distilling coal tar pitch to increase its average molecular weight by polymerization. Various oxidizing, dehydrogenating and polymerization agents may be employed to expedite the process. The treated pitch is spun into filament which is oxidized and then carbonized.

U.S. Pat. No. 4,474,617 (Nemura et al) describes treating low mesophase content pitch with oxidizing gas at a temperature of 200° to 350° C. to produce an improved carbon fiber.

Japanese Patent 65090 (Yamada et al) describes making a mesophase pitch for carbon fiber manufacture by heat treating feed in the presence of oxidizing gas at 350° to 500° C.

In published German Patent Application No. 3305-055-A (Nippon Oil KK) there is disclosed a process wherein a pitch feed is initially heat treated at 370° to 420° C. in a stream of inert gas for 5 to 20 hours under atmospheric or reduced pressure. Subsequently, an oxidant gas such as air or oxygen is passed through the pitch at 200°–350° C., one atmosphere pressure, at a flow rate of 1.0 to 3.5 SCFH for 10 minutes to 2 hours.

Koppers Co. Inc. has published DT 2221707-Q and DT 2357477 patent applications, which disclose manufacture of isotropic carbon fibers wherein the starting material is first reacted with oxygen and then vacuum distilled, to remove non-oxidized lower-boiling components.

SUMMARY OF THE INVENTION

In accordance with the present invention, it has now been found that a pitch product containing 50 to 100% by volume mesophase, as determined by optical anistropy, is obtained by contacting a carbonaceous feedstock in melt form substantially free of mesophase pitch with an oxidative gas under suitable conditions to increase the oxygen content and/or molecular weight of the feedstock but still retain a product substantially free of mesophase pitch and thereafter sparging a non-reactive gas through the molten oxidatively treated carbonaceous feedstock during heat soaking thereof. The resulting pitch product, often substantially 100% mesophase, has a melting point suitable for fiber spinning and results in fibers having greatly improved elongation properties without loss of tensile strength.

DETAILED DESCRIPTION OF THE INVENTION

The carbonaceous feedstocks used in the process of the invention are heavy aromatic petroleum fractions and coal-derived heavy hydrocarbon fractions, including preferably materials designated as pitches. All of the feedstocks employed are substantially free of mesophase pitch.

The term "pitch" as used herein means petroleum pitches, natural asphalt and heavy oil obtained as a by-product in the naphtha cracking industry, pitches of high carbon content obtained from petroleum asphalt and other substances having properties of pitches produced as by-products in various industrial production processes.

The term "petroleum pitch" refers to the residuum carbonaceous material obtained from the thermal and catalytic cracking of petroleum distillates.

Generally, pitches having a high degree of aromaticity are suitable for carrying out the present invention.

Carbonaceous pitches having an aromatic carbon content of from about 75% to about 90% as determined by nuclear magnetic resonance spectroscopy are particularly useful in the process of this invention. So, too, are high boiling, highly aromatic streams containing such pitches or that are capable of being converted into such pitches.

On a weight basis, the useful pitches will have from about 88% to about 93% carbon and from about 7% to about 5% hydrogen. While elements other than carbon and hydrogen, such as sulfur and nitrogen, to mention a few, are normally present in such pitches, it is important that these other elements do not exceed about 4% by weight of the pitch. Also, these useful pitches typically will have an average molecular weight on the order of about 200 to 1,000.

Those petroleum pitches meeting the foregoing requirements are preferred starting materials for the practice of the present invention. Thus, it should be apparent that carbonaceous residues of petroleum origin, and particularly isotropic carbonaceous petroleum pitches which are known to form mesophase in substantial amounts, for example in the order of about 90% by volume and higher, during heat treatment at elevated temperatures, for example in the range of 350° C. to 450° C., are especially preferred starting materials for the practice of the present invention.

In general, any petroleum or coal-derived heavy hydrocarbon fraction may be used as the carbonaceous feedstock in the process of this invention. Suitable feedstocks in addition to petroleum pitch include heavy aromatic petroleum streams, ethylene cracker tars, coal derivatives, petroleum thermal tars, fluid catalytic cracker residues, and aromatic distillates having a boiling range of from 650°-950° F. The use of petroleum pitch-type feed is preferred.

The preferred gas for the oxidation treatment of the carbonaceous feedstock is air or other mixtures of oxygen and nitrogen. Gases other than oxygen such as ozone, hydrogen peroxide, nitrogen dioxide, formic acid vapor and hydrogen chloride vapor, may also be used as the oxidative component in the process. These oxidative gases may be used alone or in admixture with inert (non-oxidative) components such as nitrogen, argon, xenon, helium, methane, hydrocarbon-based flue gas, steam and mixtures thereof. In general, there can be employed any gas stream or a mixture of various gas streams with an appropriate oxidative component so that reaction with the feedstock molecules occurs to provide a carbonaceous feedstock with increased oxygen content and/or increased molecular weight, but one which remains substantially free of mesophase pitch.

The temperature employed in the oxidative step is usually between about 200° C. and about 350° C. and preferably between about 250° C. and about 300° C. The oxidative gas rate is at least 0.1 SCFH per pound of feed, preferably from about 1.0 to 20 SCFH. Sparging with the oxidative gas is generally carried out at atmospheric or slightly elevated pressures, e.g. about 1 to 3 atmospheres, but higher pressures may be used if desired. The sparging time period may vary widely depending on the feedstock, gas feed rates, and the like. Time periods from about 2 to about 100 hours or more may be used. Preferably the sparging time varies from about 2 to about 30 hours.

Generally, the melting temperature of mesophase pitches is increased by oxidation treatment. It is usually desirable to spin a mesophase pitch with a melting temperature below 360° C. and preferably below 340° C. Thus, the oxidizing conditions, including the treatment time, are controlled so that the mesophase pitch melting temperature is maintained at an acceptable level for spinning.

Conversion of the oxidatively treated carbonaceous feedstock to mesophase pitch is effected by subjecting the feedstock in a molten phase to elevated temperatures, usually at atmospheric pressure with agitation and with inert gas sparging. The inert gas passes through a continuous molten phase during the sparge for maximum contact and conversion to mesophase. The operating conditions employed, which are well known in the art, include temperatures in the range of about 350° to about 500° C. and preferably from about 370° to about 425° C. The heating step is carried out over a time period of about 2 to about 60 hours depending on the temperature employed. A variety of inert gases may be used as a sparging material including nitrogen, argon, carbon dioxide, helium, methane, carbon monoxide, and steam. Sparging is carried out at a gas rate of at least 0.1 SCFH per pound of feedstock and preferably from about 1.0 to about 20 SCFH per pound.

The mesophase pitch product of this invention may be spun into continuous anisotropic carbon fibers by conventional procedures such as melt spinning, followed by the separate steps of thermosetting and carbonization. As indicated, these are known techniques and consequently they do not constitute critical features of the present invention.

The present invention will be more fully understood by reference to the following illustrative embodiments.

EXAMPLE 1

The heavy residual fraction (900° F.+ fraction) of a heavy oil from an FCC unit was used as feedstock for the preparation of mesophase pitch precursor. A glass reactor with capacity around 340 ml was used for the test and was charged with approximately 200 grams of the heavy residual oil. Air was used as the gas for the oxidation treatment, at a rate of 2.0 SCFH/lb of reactor charge. The properties and yields of products obtained from oxidation are provided in Table 1.

TABLE 1

| Temp. °C. | Time, Hr | Yield, Wt % | Oxygen Cont. Wt % | Molecular Weight | Toluene Insoluble, Wt % | THF Insoluble, Wt % | Mesophase Content Wt % |
|---|---|---|---|---|---|---|---|
| — | None | — | 0.8 | 485 | 3.8 | 0.1 | 0 |
| | 4 | 100 | 0.9 | 505 | 5.0 | 0.22 | 0 |
| 200 | 8 | 100 | 1.0 | 513 | 5.3 | 0.16 | 0 |
| | 16 | 99.4 | 1.1 | 525 | 7.2 | 0.26 | 0 |
| | 2 | 99.5 | 1.0 | 505 | 5.3 | 0.24 | 0 |
| 250 | 4 | 99.8 | 1.0 | 508 | 5.7 | 0.28 | 0 |
| | 8 | 99.7 | 1.1 | 528 | 8.8 | 0.33 | 0 |
| | 16 | 99.8 | 1.3 | 574 | 13.9 | 1.33 | 0 |
| 300 | 2 | 99.4 | 0.8 | 519 | 8.3 | 0.33 | 0 |
| | 4 | 98.5 | 0.8 | 562 | 15.6 | 1.48 | 0 |
| | 8 | 97.8 | 0.8 | 645 | 30.1 | 7.66 | 0 |
| | 16 | 94.6 | 0.9 | 765 | 55.7 | 22.9 | 0 |

The above data illustrates that the oxidation treatment provides a feedstock with an increased oxygen content and/or an increased molecular weight.

EXAMPLE 2

In the mesophase conversion step, another heavy residual fraction (900° F.+ fraction ) of a heavy oil from an FCC unit, with and without the oxygen treatment, was subjected to heat soak with nitrogen sparging at a rate of 4.0 SCFH/lb of reactor charge. A flow of high purity nitrogen containing less than 0.001 volume percentage oxygen was continuously purged through the open space underneath the reactor roof into the reactor overhead line at the rate of 4.0 SCFH/lb of reactor charge. Table 2 shows the yields and properties of the mesophase pitches from both oxygen treated and non-oxygen treated FCC heavy oils:

TABLE 2

| Feed | Feedstock I | | Feedstock II | | |
|---|---|---|---|---|---|
| Oxygen Treatment | None | | None | | |
| Temperature, °C. | — | 250 | — | 250 | 250 |
| Time, Hr | — | 16 | — | 16 | 16 |
| Gas | — | Air | — | Air | Air |
| Sparging Rate, SCFH/lb Feed | — | 2.0 | — | 2.0 | 2.0 |
| Mesophase Conversion | | | | | |
| Temperature, °C. | 385 | 385 | 385 | 385 | 385 |
| Time, Hr | 30 | 24 | 30 | 24 | 28 |
| Sparging Gas | $N_2$ | $N_2$ | $N_2$ | $N_2$ | $N_2$ |
| Sparging Rate, SCFH/lb Feed | 4.0 | 4.0 | 4.0 | 4.0 | 4.0 |
| Mesophase Pitch Yield, Wt % Based on the Feed | 36.9 | 43.6 | — | 42.3 | 42.1 |
| Mesophase Pitch Properties | | | | | |
| Melting Temperature, °C. | 312 | 332 | 304 | 321 | 326 |
| Mesophase Content, % | 100 | 100 | 100 | 95 | 100 |
| Mesophase Pitch Sample Identification | A | B | $A^1$ | $B^1$ | $C^1$ |

EXAMPLE 3

The mesophase pitches from Example 2 were spun into fiber filaments through a single hole spinnerette. The spun fiber filaments were placed in an oven and heated in air from room temperature to 350° C. at a rate of 4° C./minute and then heated at 350° C. for 32 minutes, followed by carbonization in Argon at a temperature of 1800° C. The carbonized fibers were then tested as single filaments at a 2.54 cm gauge length and 10% elongation per minute. Table 3 shows the properties of the produced carbonized fibers.

TABLE 3

| Mesophase Pitch Sample I.D. | Tensile Strength, $\times 10^3$ psi | Modulus, $\times 10^6$ psi | Elongation, % |
|---|---|---|---|
| A | 352 | 44 | 0.70 |
| B | 360 | 26 | 1.28 |
| $A^1$ | 401 | 50 | 0.73 |
| $B^1$ | 408 | 33 | 1.07 |
| $C^1$ | 364 | 26 | 1.20 |

It is noted from the data that the percent elongation of the carbonized fibers is substantially increased with no significant change in tensile strength.

Various changes and modifications can be made in the process of this invention without departing from the spirit and scope thereof. The various embodiments which have been described herein are for the purpose of illustrating the invention, and are not intended to limit it.

We claim:

1. A process for producing a pitch product having a mesophase content of from 50 to 100% by volume and a melting point below 360° C. and suitable for carbon fiber manufacture which comprises heating a molten carbonaceous feedstock substantially free of mesophase pitch in the presence of an oxidatively reactive sparging gas at a temperature of from about 200° C. to about 350° C. and for a time period sufficient to increase the oxygen content and/or molecular weight of the carbonaceous feedstock, said carbonaceous feedstock remaining substantially free of mesophase pitch after such treatment, and thereafter heating the oxidatively treated carbonaceous feedstock to a melt phase at a higher mesophase-forming temperature while passing a non-oxidative sparging gas therethrough for a time period sufficient to produce a pitch product having said mesophase content and a melting point of below 360° C.

2. The process of claim 1 in which the oxidatively reactive gas is selected from the group consisting of oxygen, ozone, hydrogen peroxide, nitrogen dioxide, formic acid vapor, hydrogen chloride vapor, and mixtures thereof.

3. The process of claim 2 in which the oxidatively reactive gas is used in admixture with an inert gas.

4. The process of claim 3 in which the oxidatively reactive gas is a mixture of oxygen and nitrogen.

5. The process of claim 2 wherein the pitch product is substantially 100 percent mesophase with a melting point not greater than 360° C.

6. The process of claim 5 in which the feedstock is a pitch.

7. The process of claim 6 in which the feedstock is a petroleum pitch.

8. A process for producing an anisotropic pitch having a mesophase content of from 50 to 100% and having a melting point of below 360° C., and suitable for carbon fiber manufacture, which comprises heating a carbonaceous feedstock substantially free of mesophase pitch in the presence of an oxidatively reactive sparging gas at a temperature between about 200° C. and about 350° C. and a sparging gas rate from about 1.0 to about 20 SCFH per pound of feedstock for about 2 to about 100 hours to increase the oxygen content and/or molecular weight of the carbonaceous feedstock, said carbonaceous feedstock remaining substantially free of mesophase pitch after such treatment, thereafter heating the oxidatively treated carbonaceous feedstock to a melt phase at a higher mesophase-forming temperature while passing a non-oxidative sparging gas through said molten feedstock to produce a pitch product having said mesophase content, said mesophase having a melting point not greater than 360° C.

9. The process of claim 8 in which the feedstock is a pitch.

10. The process of claim 9 in which the anisotropic pitch product contains from about 90 to 100% mesophase.

11. The process of claim 10 in which the oxidatively reactive sparging gas is air.

12. The process of claim 8 in which the oxidatively treated carbonaceous feedstock is heated in the presence of the non-oxidative sparging gas at a temperature of about 350° C. to about 500° C. for about 2 to about 60 hours at a sparging gas rate of from about 1.0 to about 20 SCFH per pound of feedstock.

13. The process of claim 12 in which non-oxidative sparging gas is selected from the group consisting of nitrogen, argon, xenon, helium, methane, hydrocarbon-based flue gas, steam, and mixtures thereof.

14. The process of claim 13 in which the inert gas is nitrogen.

15. The process of claim 14 in which the oxidatively reactive sparging gas is air.

16. The process of claim 15 in which the feedstock is a pitch.

17. The process of claim 16 in which the feedstock is a petroleum pitch.

* * * * *